United States Patent [19]

Keifer

[11] 4,380,097

[45] Apr. 19, 1983

[54] PRODUCT MONITORING DEVICE

[75] Inventor: Terry A. Keifer, Pottstown, Pa.

[73] Assignee: Check Mate Systems, Inc., King of Prussia, Pa.

[21] Appl. No.: 198,277

[22] Filed: Oct. 17, 1980

[51] Int. Cl.[3] ..... G08B 13/14

[52] U.S. Cl. ..... 24/160; 24/248 R; 340/572; 337/75; 292/DIG. 66; 70/DIG. 10

[58] Field of Search ..... 24/248 R, 248 B, 327, 24/350, 160; 340/572; 292/DIG. 66; 310/307; 337/75; 81/418; 70/DIG. 10

[56] References Cited

U.S. PATENT DOCUMENTS

| | | | |
|---|---|---|---|
| 3,806,910 | 4/1974 | Keifer et al. | 310/307 X |
| 3,914,829 | 10/1975 | Paskert | 340/572 X |
| 4,038,726 | 8/1977 | Takabayashi | 24/248 R X |
| 4,212,303 | 7/1980 | Nolan | 24/248 B X |

*Primary Examiner*—Robert P. Swiatek
*Attorney, Agent, or Firm*—Eugene E. Renz, Jr.

[57] ABSTRACT

A product monitoring device including a releasable locking device adapted to be secured to a product and actuatable between locked and unlocked positions. The locking device consists of a pair of movable members, one of which mounts a bimetallic member consisting of bimetal elements having different temperature coefficients of expansion, the bimetal elements being separated by an insulator. The locking device includes a detent cooperatively associated with the bimetallic member to maintain the members in a locked position. The device uses an electrifiable key for heating the bimetallic elements to effect displacement thereof relative to the detent to facilitate movement of the members to an unlocked position. The device incorporates structural features which increase strength in operation, and further serve to make unauthorized opening and/or breakage of portions, with the intent of permitting separation from an article to which attached, more difficult. Opening without use of the key is additionally more difficult in the improved device.

8 Claims, 11 Drawing Figures

PRODUCT MONITORING DEVICE

TECHNICAL FIELD

The present invention relates generally to a device or means usable in a product monitoring system in a store and more specifically to a device selectively attachable and detachable from articles of merchandise and having means for detering unauthorized removal of the merchandise from, for example, store premises.

It is well known in merchandising that the unauthorized removal of products from business premises, whether due to intentional theft or to inadvertence, produces a very substantial dollar value of losses to merchants. The most common cases of this type are intentional shoplifting of goods and thefts not only by employees but by persons entering a business establishment with this intention in mind. Such losses appear to be increasing and losses are believed to be at the rate of billions of dollars.

Attempts have heretofore been made to diminish the amount of such losses. Such attempts have included, for example, systems wherein devices or materials are affixed to products in a retail establishment or store which are readily detectable when an attempt is made to remove the product from the establishment without some appropriate action having been taken by store personnel to authorize such removal and/or to inactivate the detection means attached to the product.

Systems currently in use include visual surveillance systems by employees of the establishment and in some instances very expensive closed television monitoring systems have been incorporated or built into retail stores and establishments.

Other methods which have been utilized have included the use of means which are secured or attached to product items in a store or establishment and, in the absence of their removal by authorized store personnel, will serve to energize or activate an alarm or notification system of attempted unauthorized removal of the products.

Many other methods and systems have been in use in an attempt to prevent the so-called "shoplifting" and/or inadvertent removal of product items from a store in the absence of authorization for such removal or payment for the product. The present invention is directed to improvements in one such system and more specifically to the individual devices utilized therein.

The present invention is accordingly primarily directed to a device for use in a system to prevent unauthorized removal of products from a retail store or establishment and which device constitutes an improvement over prior known art.

BACKGROUND OF THE INVENTION

Product monitoring apparatus, systems and methods have heretofore been devised and utilized by the assignee company of the present application. The present application is directed to an improvement over the specific devices as used and disclosed in prior patents granted to this common assignee.

There is disclosed in the prior patents issued to the present assignee a product monitoring system which utilizes an electrically releasable locking device which is secured to products in the establishment and which, in the absence of removal from the product by authorized store personnel, serves to notify the store personnel of attempted unauthorized removal of the product from the premises. This has been in the nature of electrical signals triggered by the device or the device has incorporated means necessitating use of an electrifiable key to facilitate or permit unlocking of the device and removal from the product.

U.S. Pat. No. 3,718,922, entitled "Product Monitoring Apparatus, System and Method", issued Feb. 27, 1973 and U.S. Pat. No. 3,806,910, entitled "Product Monitoring Device and System", issued Apr. 23, 1974, each disclose systems and devices of the type specifically referred to and described in the present application. Both of these aforementioned prior patents are assigned to the assignee of the present application and constitute the best known prior art relating to the presently disclosed system.

While the specific devices disclosed in these prior patents have been generally usuable and have served, at least in part, to prevent unauthorized removal of products from a store, it has now been found that the devices are capable of substantial improvement which further enhance results obtained by their application and use.

Broadly speaking, the prior devices included two arms or members in the nature of a pair of pivot arms having at each free end thereof coactive securement means for attachment of the device to a product, and additionally electrically operable means actuatable to release detent means normally maintaining the two arms in a locked position with the attachment means impaled to or secured to the product.

Under some circumstances of use, and due to the construction of the device, it was possible to break or fracture the attachment or securement means which consisted, in one form, of a pin adapted for passage through the product and encasement within a notch or enclosure in an opposing arm of the device. The present invention substantially diminishes such attempts of breakage of the monitoring device for subsequent unauthorized removal of the product from the store premises.

It has also been found that the prior devices, as disclosed in the aforementioned patents, and which included two pivotally interconnected arms or members having electrical means therein constituting detents preventing unauthorized opening and removal were subject to breakage upon strenuous effort. Such breakage resulted from insertion of some object or device between the two arms and the application of a twisting force to the device such as to spread and/or twist the end jaws of the two arms, and which resulted in a disengagement of the product impaling means and an overcoming of the electrical locking means.

The details of the electrical locking means and the release thereof by application or use of an electrically powered key have been set forth in the aforesaid prior patents. The function of the structure whereby an elongated bimetallic element secured to one of the movable members or arms, mounting a locking pin at its free end normally engageable in a keeper hole or notch in the other movable member, and the actuation of the electrically powered key to deactivate the bimetallic element to thereby permit opening or separation of the two arms, and freedom of the locking pin from the keeper hole are specifically set forth in these prior patents, and will be described in detail herein only to the extent considered desirable to point out and describe the improvements of the present invention.

SUMMARY OF THE INVENTION

The present invention, accordingly, is broadly directed to devices usable in product monitoring systems to prevent unauthorized removal of products from an establishment and the overall improved device or product constituting a substantial improvement in the art as will be readily apparent hereinafter.

More specifically, the present invention discloses specific and particular improvements in the monitoring devices as shown and described in the aforesaid prior patents, which overcome some structural features therein which can result in undesireable failure of the devices in use as a result of concentrated efforts of individuals to circumvent the purpose and function of the devices and the monitoring systems.

While the improvements at first glance may appear to be small in nature, it will be seen that these structural changes result in a highly improved device, and result in attainment of highly beneficial end results for proprietors of business establishments of a nature involving the sale of products which can be readily removed from the premises by "shoplifters" and the like.

Still other objects and advantages of the present invention will become readily apparent to those skilled in the art from the following detailed description, wherein there is shown and described a preferred embodiment of the invention, simply by way of illustration of a preferred mode presently contemplated for carrying out the invention. As will be realized, the invention is capable of other and specifically different embodiments, and its several details are capable of modifications in various, obvious respects, all without departing from the invention. Accordingly, the drawings and description are to be regarded merely as illustrative in nature, and not as restrictive.

BRIEF DESCRIPTION OF THE DRAWINGS

The accompanying drawings illustrate a preferred embodiment of the invention and, when taken together with the description, serve to explain the principles of the invention.

DETAILED DESCRIPTION OF THE PREFERRED EMBODIMENT

Figure 1:
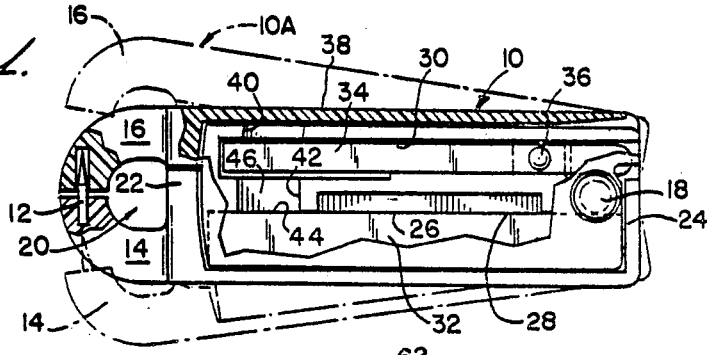
Fig. 1. (PRIOR ART)
FIG. 1 is a side elevational view of a product monitoring device of the prior art, disclosed in closed and opened positions.

Reference is here made, and incorporated by reference herein, of overall systems and operational characteristics of devices constituting the subject matter of the present invention, such systems and functions are disclosed respectively in FIG. 1 of U.S. Pat. No. 3,718,922 and FIGS. 1–3, inclusive, of U.S. Pat. No. 3,806,910. A detailed discussion in these connections is not felt necessary in the present application.

Referring now to the drawings, and particularly to FIG. 1 which is representative of the prior art as illustrated in the aforementioned prior patents, there is illustrated a locking device generally designated 10. This locking device is adapted to be secured to articles of merchandise, not shown, and adapted to be inactivated for release from the article by actuation of an electrifiable key, disclosed in detail in the prior art. Upon actuation of the electrifiable key, the locking device 10 can be actuated to an open position as shown in broken lines at 10A. Preferably the locking device incorporates means to effect actuation of an alarm if the article with the locking device applied thereto is removed past a detection station.

As described in the prior patents, the locking device and its actuatable key are particularly adapted for use in retail stores which typically include a main area for displaying articles of merchandise, and one or more check-out counters past which each customer must travel on his way to an exit in the store. These check-out counters are usually provided with a cash register. Also located at each check-out counter will be an electrifiable key, referred to above, by means of which store personnel may release the locking device 10 from articles of merchandise as they are declared and paid for. At each exit there is located a detection station for detecting unauthorized removal of products, and for producing an alarm indication of attempted unauthorized removal if an article of merchandise with the locking device 10 is taken past the exit, each protected product on the premises having a locking device 10 secured thereto.

The locking device of the invention and particularly of the type shown in the drawings is adapted for being applied to a fabric or the like and includes a pin 12 which penetrates the goods to hole the locking device firmly in place. As illustrated, the locking device includes a pair of arms 14, 16 which are pivotally interconnected one to another by a pivot means 18 of any desired type. By means of the pivotal connection, the arms 14, 16 can be pivoted from the closed position shown in solid lines in FIG. 1 to an open position shown in broken lines in that figure after the device has been unlocked. In the open position the device may be removed from the product.

When the arms are moved to the closed position the device snaps into a locked condition and, as described in U.S. Pat. No. 3,806,910, can be released only by application of electric current thereto by a key. A schematic wiring diagram to effect this operation is set forth in FIG. 3 of the drawings. It is, of course, to be understood that the device may be applied to merchandise other than fabric. For example, the opening between the arms, generally indicated at 20, can be of a configuration adapted to encircle a cord of an appliance or the like. Obviously, such an opening can be utilized to encircle objects or portions thereof of different types and as applied to different products, and to secure protruding portions of elements by means of the locking device.

The locking device preferably includes means whereby its unauthorized removal past a detection station will sound an alarm. There are a variety of means known in the art by means of which this can be provided. For purposes of the present description, it can be assumed that the locking device contains a magnet 21 affixed to one of the arms and that the detection station includes appropriate magnetrometer apparatus for detecting the passage of a magnet past it.

As described in the aforementioned U.S. Pat. No. 3,806,910, a key of a particular configuration and a particular electric current are required to release the locking device, making it difficult for a would-be thief or shoplifter to release the locking device other than by attempted destruction or manual forcing of portions to inoperative or unmating conditions or positions. As is described in this aforementioned patent, the locking device is preferably made in a simple, convenient and inexpensive form, particularly as to the locking and unlocking arrangement which, as shown therein, comprises a bimetallic element heated by an electric applied current in order to effect unlocking of the device.

Considering now more specifically the structural arrangement and details of the electrically releaseable locking device 10 in accordance with the present invention, the device comprises a male jaw 14 and a coactive female jaw 16 and which are pivotally mounted to one another at 18. The device accordingly may be selectively actuated between a closed or locked position shown in solid lines in FIG. 1 and an open or released position shown in broken lines. The members preferably are constructed of a plastic material and are of a simplified configuration so that they may be easily molded.

As shown in prior U.S. Pat. No. 3,806,910, the male arm member 14 generally comprises or includes a rectangular side wall, top and bottom walls respectively projecting from the inner edges of the side wall and a pair of opposed end walls 22, 24, one of which mounts the arm 14. The male member further includes a center partition 26 dividing the interior into two elongated compartments, one of which is indicated at 28 and the other at 30. The lower compartment 28 houses at least one conventional magnet 32 and the upper compartment 30 houses a bimetallic element generally designated 34.

The bimetallic element, as shown and described in detail in U.S. Pat. No. 3,806,910, preferably comprises a pair of thin elongated members of different metals or alloys and which have different temperature coefficients of expansion. The two members are preferably secured together, for example, by welding at their outer ends and are secured by means of a plastic button such as shown at 36 in FIG. 1 of the present application. A strip of insulating material, not shown, is interposed between the members of the bimetallic element and one of the members is off-set at its terminal rear portion to define one of a pair of contacts for coacting with a contact provided on the other of the bimetallic members.

The female member or arm 16, as shown in detail in U.S. Pat. No. 3,806,910, likewise comprises a generally rectangular side wall adapted to overlie the open portion of the compartments 28, 30 of the male member in the assembled position and a top wall 38, extensive with the side wall, confronting and overlying the top wall of the male member. The side wall of the female member operatively incorporates a button-like member which constitutes a portion of the pivot means 18 interconnecting the two arms together. An open socket is provided in the female member as shown in the prior patent. The forward ends of the arms 14, 16 are shaped in a manner to provide the generally circular opening, generally designated 20, and through which a portion of an article of merchandise may be secured.

Adjacent the forward end of the male member, the top wall and center partition thereof are provided with aligned cutouts 40, 42, respectively, and a tapered detent shown in broken lines at 44, formed integrally with the side wall of the female member which clears a pocket 46 formed by the cutouts to allow pivotal movement of the members. The bimetallic element 34 in the normal unheated position extends across the pocket 46 so that when the device is locked, a flat shoulder portion of the detent engages under the bimetallic element to prevent opening of the device or pivotal movement of the male and female members relative to one another. When, however, the bimetallic element is heated, it is deflected to a position out of the range of the detent 44, thereby permitting the male and the female members to be pivoted about the pivot 18 to an open position. Of course, once the bimetallic element is cooled and returned to its normal position, the clip may be closed, and the detent, having a tapered front face, springs the bimetallic element inwardly to permit closing. However, when the detent 44 passes the position of the bimetallic element, it snaps back into place to securely lock the members in a closed position. The details of this described portion of the invention are set forth clearly in the drawings and description in prior U.S. Pat. No. 3,806,910.

Means hereinafter described generally, and with reference to an electrical circuit for the device, are controlled for passing a heating current electricity through the bimetallic element to electively control actuation thereof as above described.

Figure 3:
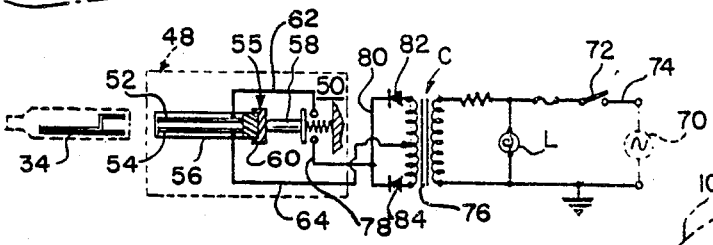
Fig. 3. (PRIOR ART)
FIG. 3 is a schematic electrical actuating system for opening the device by an insertable key.
Figure 9:
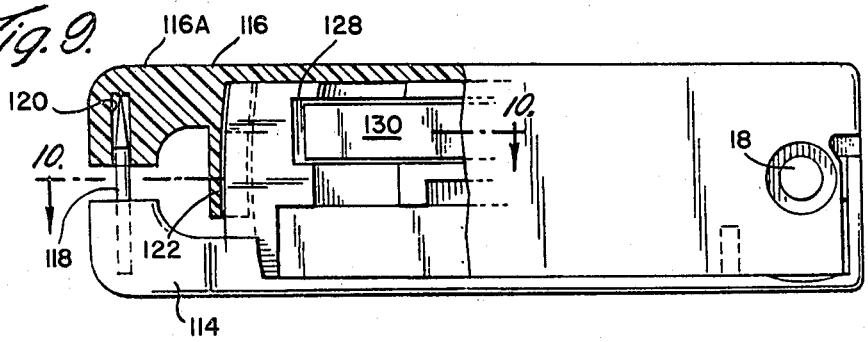
FIG. 9 is a side elevational view, partly in section, of the improved product monitoring device of the present invention, parts being broken away to disclose improvements.
Figure 11:
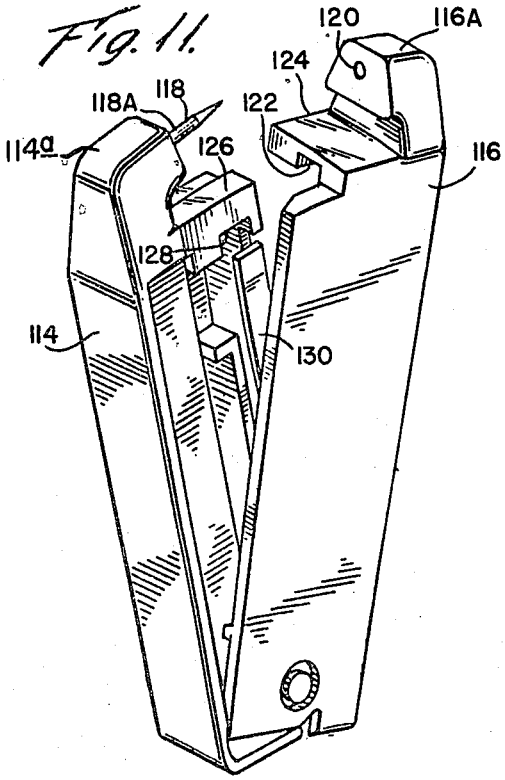
FIG. 11 is a perspective view of the new monitoring device, disclosing details of construction for preventing unauthorized forced opening of the device.
Figure 10:
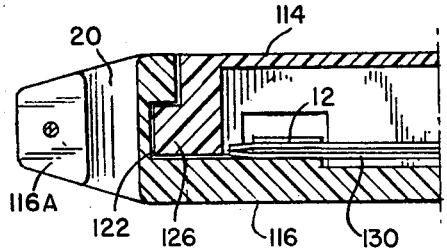
FIG. 10 is a fragmentary, sectional plan view of the improved device taken on line 10—10 of FIG. 9.

The details of a release key are illustrated in FIGS. 9–11, inclusive, of U.S. Pat. No. 3,806,910 and generally are indicated at 48 in broken lines in FIG. 3. Generally, the key includes an elongated hollow housing of material and construction so that it can be easily constructed of plastic material by a molding operation. The housing is provided with a rear open compartment for mounting therein the on-off switch 50 (FIG. 3) and a forward compartment for the pair of electrical contacts 52, 54. The specific mounting for the contacts 52, 54 is generally indicated at 55 and reference is again made to the aforementioned patent for details. The mounting includes an insulating member disposed between the contacts and appropriately mounted. The key includes a movable shuttle 56 which is normally biased to an outer position by means of a spring biased pin 58 of the on-off switch 50. The shuttle 56 is so shaped as to straddle the contacts 52, 54 and in its forwardmost position the front end of the shuttle lies flush with the outer terminal ends of the contacts as illustrated and described in FIG. 9 of U.S. Pat. No. 3,806,910. The shuttle is provided with a construction and configuration to limit its forward position and further includes a shim 60 to insure proper contact with the pin 58. Means are incorporated to define a rear limit position of the shuttle. The forward end of the key has a shaped opening to accommodate the locking device, shown in broken lines (FIG. 3), in an appropriate manner. Additionally, the contacts 52, 54 are spaced apart laterally a distance so that when the locking device is operatively inserted, and the shuttle actuated rearwardly, the contacts engage in the socket in the locking device and effect engagement with the outer terminal ends of the bimetallic element. In this position, the actuating pin 58 is depressed to an "on" position thereby closing the circuit to effect heating of the bimetallic strip which, as previously described, permits the locking device to be actuated to an open position. As shown in FIG. 3, contact 52 is connected through a lead 62 to one of the contact arms of switch 50 and the other contact 54 is connected through lead 64 to control circuit C.

Figure 4:
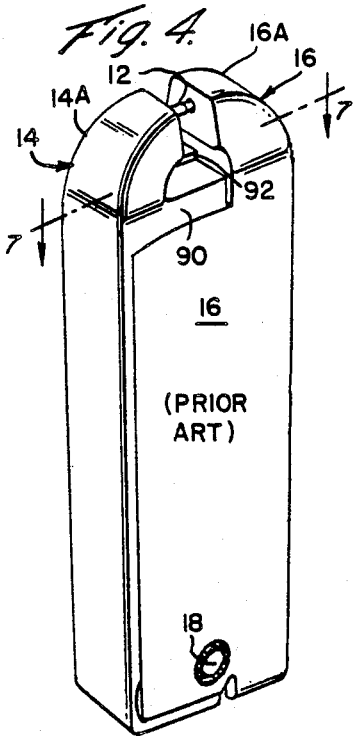
FIG. 4 is a perspective view of the prior art clip of FIG. 1 in closed condition.

The power control circuit C for the key, as illustrated in FIG. 4, includes a main power supply 70, a switch 72 connected through lead 74 to one terminal of the power supply, the switch 72 being connected to one side of the primary of a transformer 76. The center tap of the secondary of the transformer is connected through electrical lead 64 to one of the contacts 54 of the key, and the lead 78 connects one terminal of the on-off switch 50 to the electrical lead 80 bridging rectifiers 82 and 84. The circuit also includes an indicator lamp L which is energized when the switch 50 is closed.

Under normal conditions, i.e. when an article has been purchased and passes through a check-out counter or the like, the anticipated normal operation of the locking device and key will take place. Personnel at the check-out counter are in control of the electrified keys. Assuming that the switch 50 has been closed to condition the key for releasing the locking device, then when the locking device is operatively inserted into coacting position with the key, and the locking device and key are actuated relative to one another, this will serve to displace the shuttle 56 rearwardly to actuate the on-off switch 50, and thereby closing the circuit to the contacts 52, 54. In this position, the contacts of the bimetallic elements engage the contacts 52, 54 and this completes the circuit to one of the bimetallic elements and effects flow of current between the two elements. After a predetermined short time, this current heats the bimetallic elements sufficiently to cause a bending out of the range of detent 44 and the locking device may then be removed from the key and the jaw members 14, 16 pivoted to an open position to remove the device from the article of merchandise. As the locking device is removed from the key, the shuttle is biased to a forward position by the spring actuated plunger 58, thereby opening the circuit to the power for the contacts 52, 54.

Figure 2:
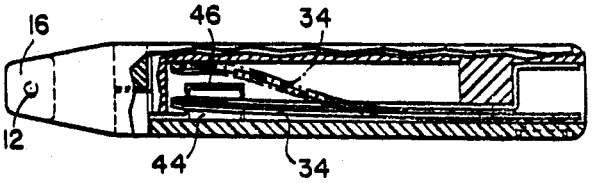
Fig. 2. (PRIOR ART)
FIG. 2 is a plan view of the device of FIG. 1, partly in section.
Figure 5:
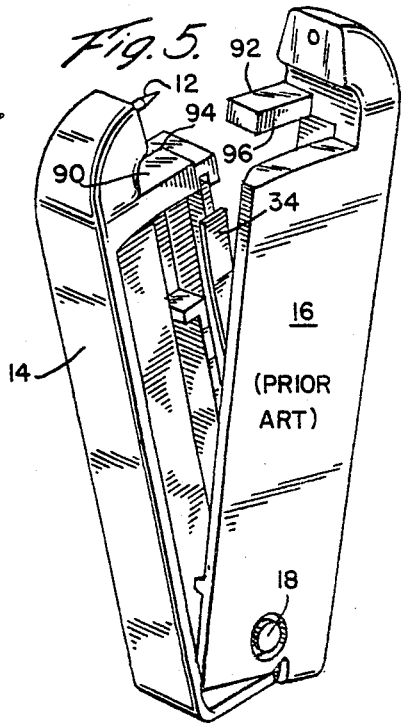
FIG. 5 is a perspective view of the device of FIG. 4 in properly opened position.
Figure 6:
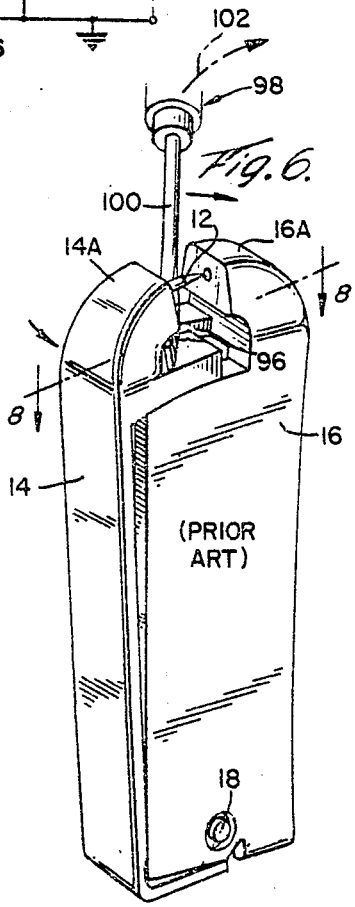
FIG. 6 is a perspective view of the initiation of an improper opening of the device shown in FIG. 4.
Figure 7:
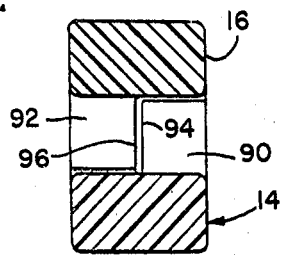
Fig. 7 (PRIOR ART)
FIG. 7 is a sectional view taken on line 7—7 of FIG. 4.

The foregoing description as directed primarily to FIGS. 1 and 2 relates to the prior art device set forth in U.S. Pat. No. 3,806,910. Unfortunately, however, various attempts to circumvent this safety or monitoring device have been used by persons attempting to steal or shoplift the articles to which the devices are attached. Reference is here made to FIGS. 4, 5 and 6 of the drawings which respectively disclose in closed and open perspective views the results of intentional forced openings of the device of FIG. 1. The first attempt to circumvent protection afforded by this device, i.e. to remove the same from the article prior to passing a check-out point or zone, would consists of an attempt to rupture or break the pin 12 by engagement of a tool or the like therewith. In order to overcome this possible problem, the present invention incorporates a longer or deeper pin so that the two arms must be separated a greater distance apart in order to separate the two arms and remove the same from the product. In addition to this effective lengthening of the pin, the pin is now constructed of a harder material of a type well known in the art and which is not as susceptible to rupture or breakage. Materials of this type are known. Additionally, the size or cross-sectional dimensions of the pin can be enlarged to again increase a necessary force to rupture or break the same.

If the attempt to break or rupture the pin to facilitate removal of the device from the article such as cloth material or the like is not effective, an additional effort might be made to destroy the device even though such additional effort might alert personnel in the establishment. In other words, if an attempt to pry off the device by breaking the pin is not effective due to greater strength now being provided, and the greater distance of separation of the arms required, a subsequent attempt might incorporate a physical twisting of the two arms with respect to one another which could result in such physical distortion or breakage of the arms and/or other portions of the device as to permit removal. The present invention incorporates an additional safety feature to overcome or substantially reduce the possibility of this twisting effort.

Referring again to FIG. 1 of the drawings, in conjunction with FIGS. 4, 5 and 6, it will be seen that the arms 14 and 16, respectively, at their terminal ends, indicated at 14A, 16A, respectively, include, rearwardly of those portions forming the rear end of opening 20, end portions 90 and 92 as more clearly shown in FIG. 5. The end portion 90 is formed on the end wall 22 of the male arm 14 whereas the end member 92 is formed on arm 16 in a corresponding forward position similar to that of end portion 90. These end portions serve in the prior device to constitute coacting teeth or abutment members with their sides 94, 96, respectively, slidably engaging upon moving of the two arms to the closed position. It will further be noted from an inspection of FIGS. 4, 5 adn 6 that these end portions 90, 92 additionally serve as forward wall surfaces or members forming the rear of opening 20. The opening 20 is coactive with the pin 12 to form that opening which is adapted to surround or contain a portion of a member or article to which the monitoring device is attached.

While this construction has been found to be quite satisfactory under some circumstances, it does have a drawback when a very determined effort is made to fracture or open the ends of the monitoring device constituting the prior art, as disclosed in prior U.S. Pat. No. 3,806,910. Reference is here made particularly to FIGS. 5, 6, 7 and 8. While a far greater effort, and of necessity a more secretive or closed off area of an establishment is necessary for the attempt, the insertion of a tool or object 98, see FIG. 6, having a relatively sharp or pointed end 100, can be utilized in an opening or breakage effort. With the end 100 inserted under the pin and engaged with the inner edge 96 of end portion 92, an initial effort can be made to fracture or rupture the pin. If this fails then a continued rotational movement of the tool 98, with its end engaged over the outer edge 104, for example, of that surface of arm 14 forming a portion of the opening 20, a rolling or rotational movement of arm 16, is indicated by arrow 106 will take place. Probably the edge 104 will, in this effort, be broken or otherwise fractured or damaged. The edge, however, serves as a fulcrum point so that the tool, as moved in the direction of arrow 102, will cause this rotational movement of arm 16 as shown by arrow 106. The result of this is a rolling of one arm from the other and with a disengagement of the interlocking means as above described.

The structure of the present invention to prevent such attempts to disengage the monitoring device, which was possible with the construction of the prior art, is disclosed in detail in FIGS. 9, 10 and 11 of the drawings. In this construction, the arm 114, which constitutes the male arm, is similar to the arm 14 of the prior device. The arm 116 corresponds to the female arm 16 of the prior art device. The terminal end 114A again mounts a pin-like member 118 and the terminal end 116A of arm 116 has a pin receiving aperture 120 therein. Attention is here invited to the fact that the pin-like member 118 has a base portion 118A with a substantial length and the pin is constructed of a hardened, break and cut resistant material of greater strength than utilized in the prior device. This shank or base 118A is also of such length that the pin penetrated a greater distance within aperture 120, which in this construction is deeper than in the prior construction due to a slight squaring off modification of terminal end 116A. This interrelationship of parts and sizes interposes a greater length of the larger diameter pin portion in the gap formed between the arms and even a slight spreading of the terminal ends will still incorporate, interposed therebetween, a segment of the enlarged diameter pin. This, of course, serves to increase a necessary force attempting to break and/or disengage the pin and thereby permit disengagement of the monitoring device from the article to which it is attached.

Additionally, however, and of very substantial significance, is the inclusion of a medianally positioned inwardly opening groove 122 in the inner surface of end wall 124 of arm 116, and which corresponds broadly with end portion 92 of arm 16 in the prior art construction.

Figure 8:
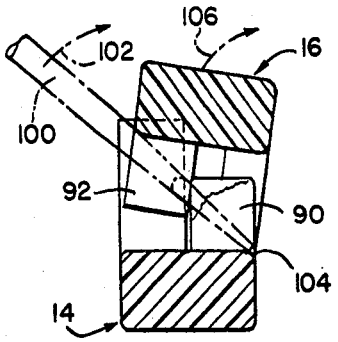
Fig. 8. (PRIOR ART)
FIG. 8 is a sectional view taken on line 8—8 of FIG. 6 schematically illustrating an improper opening of the device.

The arm 114 is here provided with a medially disposed nose or projection in the nature of a rib at 126, and which is so spaced and of such a size as to enter into groove 122 upon closing of the two arms 114, 116 with respect to one another, and with their interengagement attaching the monitoring device to an article. It will be noted that the groove and the projection are both elongated and of comparable dimensions to provide a fairly snug or fitted interengagement. This dimensioning is to obviate to a substantial degree any attempted rotation of one arm terminal end and associated arm with respect to the opposite, in a manner as above described and as shown in FIG. 8 of the drawings.

Functionally, therefor, the groove embraces the central nose or rib within the two sides or edges thereof. Attention is also invited to the disposition of a notch 128 in the inner edge of projection 126. It will be noted that the bimetal strip in this construction overlies the locking tong on the upper cover portion. The construction is such that it is virtually impossible, in the absence of complete destruction of the monitoring device, to open the present unit without utilizing an open key similar to that of the prior art.

By the increased strength and fracture or breakage proof construction built into this new monitoring device, a very substantial contribution and improvement to the art has been effected. It is to be noted, however, from FIG. 11, which is a perspective view of the new monitoring clip, in fully opened position, that with the exception of what can be referred to as the jaws on the terminal ends of the arms, the structure is otherwise substantially similar to that of the prior art.

The foregoing description, when taken together with the accompanying drawings, discloses in detail a single preferred form of the invention and the operation thereof. The differentiation in constructional features with respect to the prior art as shown in the aforementioned patent will be readily apparent. The safety characteristics which are incorporated in the new structure will be readily appreciated. Obviously, some minor changes in details can be effected without departing from the spirit and scope of the invention as defined in and limited solely by the appended claims.

I claim:

1. A releasable locking device adapted to be secured to a product, comprising:

a pair of relatively moveable members;

a locking element movable between a locking position in which said members are locked together and a release position in which said members are unlocked from each other to permit relative motion thereof;

means for operatively controlling actuation of said locking element to control the locking and unlocking of said members;

said members including a pair of arms, one of said arms mounting at its terminal end at least one pin member engagable in at least one socket in the terminal end of the other arm;

said terminal ends being adapted for movement to mating contacted positions as said members are moved to the locked positions thereof;

one of said ends having a groove therein;

the other of said ends having a projection thereon;

said projection being operatively engaged within said groove as said members are moved to the said locked position thereof and when so engaged constituting means opposing relative twisting of one moveable member with respect to the other and deterring disengagement of said ends by a relative twisting movement therebetween.

2. A releasable locking device as claimed in claim 1, said groove being elongated and spaced intermediate the sides of said member end, said projection being elongated and being continually progressively interposed and relatively tightly edgewise engaged within said groove as said moveable members are moved to locked position.

3. A releasable locking device as claimed in claim 2, said pin member consisting of a hardened, break and cut resistant material, the end of said pin member mounted in said one of said arm terminal end having a larger diameter than that of the free end of said pin engageable in said socket, said larger diameter portion being positioned intermediate said arm terminal ends with said arms in locked position.

4. A releasable locking device adapted to be secured to a product, comprising:

a pair of relatively movable members;

a locking element comprising bimetallic means having different configurations at different temperatures movable between a locking position in which said members are locked together and a release position in which said members are unlocked from each other to permit relative motion thereof;

for controlling movement of said locking element from one of said positions to the other thereof;

means for controlledly applying an electrical current to said bimetallic means to change its temperature and thereby control the locking and unlocking of said members;

said movable members having ends thereon adapted for movement to mating positions as said members are moved to the locked position thereof;

one of said ends having a groove therein;

the other of said ends having a projection thereon; and said projection being operatively engaged within said groove as said members are moved to the said locked position thereof, and when so engaged constituting means opposing a relative twisting of one said movable member with respect to the other and thereby deterring disengagement of said ends by a relative twisting movement therebetween.

5. A releasable locking device adapted to be secured to a product, comprising:

a pair of relatively movable members;

a locking element comprising bimetallic means having different configurations at different temperatures movable between a locking position in which said members are locked together and a release position in which said members are unlocked from each other to permit relative motion thereof;

means for controlledly applying an electrical current to said bimetallic means to change its temperature and thereby control the locking and unlocking of said members;

said members including a pair of arms, one of said arms mounting at its terminal end at least one pin member engageable in at least one socket in the terminal end of the other arm;

said terminal ends being adapted for movement to mating contacted positions as said members are moved to the locked position thereof;

one of said ends having a groove therein;

the other of said ends having a projection thereon;

said projection being operatively engaged within said groove as said members are moved to the said locked position thereof, and when so engaged constituting means opposing relative twisting of one movable member with respect to the other and thereby deterring disengagement of said ends by a relative twisting movement therebetween.

6. A releasable locking device as claimed in claim 5, said groove being elongated and spaced intermediate the sides of said member end, said projection being elongated and being continually progressively interposed and relatively tightly edgewise engaged within said groove as said movable members are moved to locked position.

7. A releasable locking device as claimed in 6, wherein said pin member comprises a hardened, break and cut resistant material, the end of said pin member mounted in said one of said arm terminal end having a larger diameter than that of the free end of said pin engageable in said socket, said larger diameter portion being positioned intermediate said arm terminal ends with said arms in locked position.

8. In a product monitoring system comprising an electrically releasable locking device adapted to be locked to a product, said locking device being detectable upon unauthorized removal past a predetermined checkpoint, and an electrically powered key operative to release said locking device when applied thereto to permit removal of said device from said product for subsequent authorized removal of said product, wherein;

said electrically releasable locking device includes a pair of relatively movable members;

a locking element comprising bimetallic means having different configurations at different temperatures movable between a locking position in which said members are locked together and a release position in which said members are unlocked from each other to permit relative motion thereof;

means for controlledly applying an electrical current to said bimetallic means to change its temperature and thereby control the locking and unlocking of said members;

said movable members having ends thereon adapted for movement to mating positions as said members are moved to the locked position thereof;

one of said ends having a groove therein;

the other of said ends having a projection thereon; and said projection being operatively engaged within said groove as said members are moved to the said locked position thereof, and when so engaged constituting means opposing a relative twisting of one said movable member with respect to the other, and thereby deterring disengagement of said ends by a relative twisting movement therebetween.

* * * * *